US011668028B2

(12) United States Patent
Gesing et al.

(10) Patent No.: US 11,668,028 B2
(45) Date of Patent: Jun. 6, 2023

(54) DEVICE AND METHOD FOR HANDLING HARNESS ELEMENTS

(71) Applicant: Groz-Beckert KG, Albstadt (DE)

(72) Inventors: Karl-Heinz Gesing, Raesfeld (DE); Bernd Pfeffer, Haigerloch (DE); Stefan Kailer, Meßstetten (DE); Michael Acker, Albstadt (DE); Christian Gerth, Meersburg (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 17/619,865

(22) PCT Filed: Jun. 4, 2020

(86) PCT No.: PCT/EP2020/065431
§ 371 (c)(1),
(2) Date: Dec. 16, 2021

(87) PCT Pub. No.: WO2020/254115
PCT Pub. Date: Dec. 24, 2020

(65) Prior Publication Data

US 2022/0205148 A1 Jun. 30, 2022

(30) Foreign Application Priority Data

Jun. 17, 2019 (EP) ..... 19180573

(51) Int. Cl.
*D03J 1/14* (2006.01)

(52) U.S. Cl.
CPC ..... *D03J 1/14* (2013.01)

(58) Field of Classification Search
None
See application file for complete search history.

(56) References Cited

U.S. PATENT DOCUMENTS 1,119,824 A * 12/1914 Hayward ..... D06C 3/04 26/93
4,760,628 A * 8/1988 Kaufmann ..... D03J 1/14 28/208

(Continued)

FOREIGN PATENT DOCUMENTS

CH 685203 A5 4/1995
CN 1318116 A 10/2001

(Continued)

OTHER PUBLICATIONS

International Search Report and Written Opinion dated Sep. 4, 2020, in corresponding International Application No. PCT/EP2020/065431, with machine English translation (17 pages).

(Continued)

*Primary Examiner* — Khoa D Huynh
*Assistant Examiner* — Grace Huang
(74) *Attorney, Agent, or Firm* — Fitch, Even, Tabin & Flannery LLP

(57) ABSTRACT

A device and a method for handling of weaving accessories are disclosed. The device has a first holding element and at least one further holding element for weaving accessories. The first holding element and the at least one further holding element are provided for being moved cyclically between a supply device and a receiving device. At least the first holding element is configured to complete at least part of its movement between the supply device and the receiving device while the at least one further holding element remains stationary.

13 Claims, 2 Drawing Sheets

(56) References Cited

U.S. PATENT DOCUMENTS 5,084,950 A * 2/1992 Okuda ..... D03J 1/14 28/205
5,136,762 A 8/1992 Gironi
5,282,299 A * 2/1994 Tachibana ..... D03J 1/14 28/208
5,287,605 A 2/1994 Badertscher et al.
5,353,487 A * 10/1994 Choh ..... D03J 1/14 28/208
5,475,906 A * 12/1995 Magdika ..... D03J 1/14 28/208
6,199,249 B1 * 3/2001 Gauer ..... D03J 1/14 28/208
6,230,377 B1 * 5/2001 Tanno ..... D03J 1/14 28/208
6,257,160 B1 * 7/2001 Keire ..... B63H 9/067 114/102.29
6,418,973 B1 * 7/2002 Cox ..... C04B 35/185 139/383 R
7,356,893 B2 * 4/2008 Bachmann ..... D03J 1/14 28/198
2005/0028335 A1 2/2005 Bachmann

FOREIGN PATENT DOCUMENTS

CN 101613905 A 12/2009
DE 69008100 T2 11/1994
GB 798232 A 7/1958
WO 92/05303 A1 4/1992
WO 9913146 A1 3/1999

OTHER PUBLICATIONS

Extended European Search Report and Written Opinion dated Nov. 29, 2019, in corresponding European Application No. 19180573.8, with machine English translation (13 pages).
National Intellectual Property Administration, P.R. China, Chinese Search Reporting in corresponding application CN 202080044483.0 dated Sep. 3, 2022; 3 pages.

* cited by examiner

DEVICE AND METHOD FOR HANDLING HARNESS ELEMENTS

CROSS REFERENCE TO RELATED APPLICATIONS

This patent application is the national phase of PCT/EP2020/065431, filed Jun. 4, 2020, which claims the benefit of European Patent Application No. 19180573.8, filed Jun. 17, 2019.

TECHNICAL FIELD

The present invention relates to a device, such as a drawing-in machine, for handling weaving accessories and a method for handling weaving accessories.

BACKGROUND

A drawing-in machine is a machine for drawing threads or warp threads into weaving accessories. It can be broken down into various functional units and has corresponding devices and components thereof. These include, for example, devices for the supply of healds and drop wires, through which the threads will be drawn. In these supply devices, the weaving accessories are suspended contiguously on rail-like guideways, as is generally the case, for example, for sales purposes or during weaving. On the so-called "loading side", additionally, a device is needed for holding a reed in readiness. The central device in a drawing-in machine is a drawing-in device that typically guides the threads through reed, heald, drop wire and through components of a lease. On the "unloading side", i.e. after drawing-in has been effected, the drawn-in drop wires and healds have to be removed from the vicinity of the drawing-in device in order to prevent backward congestion. In the drawing-in device, healds and drop wires are mostly transported fast over short distances in order to achieve a high drawing-in repetition rate. Once drawn in, the weaving accessories have to be pushed over mostly lengthy, rail-like guideways. Their removal is mostly slow, although the weaving accessories have to travel relatively large distances. These are typically 2 to 3 m, but sometimes distances of up to 6 m are required. On the "unloading side", drop wires and healds are often transported away parallel, in devices arranged beside each other. The present invention relates to the transport of weaving accessories from a supply device to the drawing-in device and on to the receiving device. The invention relates advantageously to a module for the transport of healds, but drop wires are not excluded.

The DE69008100T2 describes a drawing-in machine that guides healds on strip-like rails and transports and positions them by means of various rams or pushers. A rotatable rail makes it possible, if desired, to select the transport direction for pushing off the weaving accessory onto a predetermined heald frame. The CH685203A5 discloses a drawing-in machine in the case of which, after they have been separated, the healds are initially transported on a rotatable disc and then transferred to one of a plurality of rods by a gripper that is linearly movable in two directions. For the required transfer of the healds, the movements of disc and gripper must be mutually coordinated and may have to wait until the other element in each case has completed its movement.

The WO9205303A1 discloses a drawing-in machine in the case of which numerous holding means for healds are mounted at regular intervals on a carrier. After being separated, a heald remains on the same holding means from drawing-in until push-off. This practice is intended to enhance the reliability of the drawing-in machine and to enable a modular construction.

For reasons inherent in the system, both of the above options for handling weaving accessories in a drawing-in machine have limitations regarding flexibility and speed. These reduce the profitability of these cost-intensive machines.

SUMMARY

Starting from the above-cited prior art, the object of the present invention is to provide a device for handling weaving accessories and a method for handling weaving accessories, which allow flexible drawing-in at high speed.

The device according to the invention for handling weaving accessories comprises a first holding element and at least one further holding element for weaving accessories. The first holding element and the at least one further holding element are provided to be moved cyclically between a supply device and a receiving device. The device according to the invention is characterised in that at least the first holding element is provided in such a way that it is able to complete at least part of its movement from the supply device to the receiving device while the at least one further holding element remains stationary. A holding element that has moved from the supply device to the receiving device preferably moves from the receiving device back to the supply device and the motion sequence generally begins anew. It is advantageous for a holding element to move on a different path line from the receiving device to the supply device than the one from the supply device to the receiving device. The path line of a holding element advantageously lies in one plane. The movement performed by the holding element for a handling process is interrupted at the supply device and at the receiving device. Further handling devices, at which the holding elements' cyclic movement is interrupted, may be arranged between the supply device and the receiving device. The holding elements transfer the weaving accessories from the supply device to the receiving device. Additional handling devices, such as a drawing-in device, may be arranged in the device in such a way that the holding elements, while performing their sequence of cyclical movements, can generally be moved from the supply device to the additional handling devices and finally to the receiving device. From the receiving device, the holding elements can be moved, without their holding any weaving accessories, back to the supply device in order to pick up weaving accessories again and move to the further handling devices and finally to the receiving device.

Compared to the drawing-in machine of the DE69008100T2, the device works faster because at least two weaving accessories are handled simultaneously at handling devices by means of the at least two holding elements. The increase in speed compared to the WO9205303A1 results from the fact that each holding element need only remain at a handling device or at a component of the handling device in question until the handling process there has been completed. It can then be moved on to the next handling device and the next handling process irrespective of other holding elements and handling processes that are taking place. The handling process that takes longest does not, therefore, determine the length of time spent by all the other holding elements at handling devices or at components of handling devices at which handling processes take place that possibly need less time. On account of their being independent of the movements of other holding elements, each holding element can at least be flexibly arranged at or moved to the next free component of a handling device and can thus handle weaving accessories flexibly at handling devices, for example pick them up or push them off. Consequently, diverse healds, for example, (such as forwardly and rearwardly recessed healds) may be mixed flexibly without the need for additional measures. For this purpose, for example, the different types of heald are simply held ready, each type on a distinct sub-device such as a guide rail of the supply device, for transfer to the receiving device.

The device according to the invention may be, in particular, a module, such as a heald module, of a modular drawing-in machine. The module can preferably be separated, both mechanically and electrically, from the drawing-in machine without impairing the operation of the other modules. According to a preferred embodiment, the module can also perform its tasks if other modules have been deactivated or even deinstalled. The heald module's supply device may have one or more components at which the holding element can take over a heald from a stack. The holding element is able to move a weaving accessory, such as a heald, to various handling devices. These may include a drawing-in device, a measuring device, a labelling device, an ejection device or other devices. A drawing-in machine may serve to draw a thread through a thread eye of a heald. Healds may be categorized according to their quality by means of a measuring device, and, for example, labelled accordingly if necessary, (labelling device) or rejected (ejection device). Typically, healds into which a thread has been drawn are pushed off onto one of usually several separate components of a receiving device. These components of a receiving device may be carrier rails of heald frames or rail-like guideways associated with such carrier rails. The receiving device may be a component of a drawing-in machine. The receiving device may be a component of a weaving-accessory trolley. Maximum parallelization of handling processes is achieved when the number of holding elements is at least as great as the number of handling devices. Where appropriate, it is advantageous for the holding elements to make intermediate stops without a handling process taking place.

The holding element may be of pencil-shaped or rod-shaped configuration. The holding element may be configured to engage an end loop of a weaving accessory, in particular of a heald. The holding element may have a short longitudinal extension which at least suffices for it to pick up a weaving accessory reliably, taking all tolerances into consideration. The holding element may consist of a steel in order to prevent rapid wear due to contact with the weaving accessories.

A supply device may have one or more rail-like components to provide weaving accessories ready for drawing in. The supply device may have one or more separation means for singling out weaving accessories. The supply device may be a component of a heald module.

Each holding element may be disposed at a carrier means. Among other uses, a carrier means may serve to initiate the movement of a holding element by being operatively connected to an actuator. A push-off element may be provided at one or more carrier means or at each carrier means. Provision of a push-off element at carrier means or even at every carrier means obviates the need to assign a push-off element in the form of an (e.g. electrical or pneumatic) actuator to each component of a handling device and, in particular, to the receiving device, thereby simplifying the device and increasing its profitability on account of reduced susceptibility to problems. This effect can be enhanced if the push-off elements comprise mechanical actuators formed by simple mechanical springs. These may be pretensioned, for example by the movements of the carrier means, which are necessary anyway, relative to a stationary device element of the stationary machine components. For example, a push-off element may be configured to be moved by a mechanical actuator operably connected to at least one of the carrier means and a mechanical tension is built up in the mechanical actuator by a stationary device element when the at least one of the carrier means moves past the stationary device element. The push-off elements are advantageously locked automatically on being pretensioned, for example by means of a mechanical form fit. In the case of carrier means that perform a rotary movement, the stationary device element preferably has a contact surface for a pretensioning element of the carrier means, whose distance with respect to a common axis increases or decreases in order to deflect the pretensioning element as it moves past in radial direction and, in this way, to pretension a mechanical actuator, preferably an extension spring or a compression spring. Detensioning and release, causing the weaving accessories to be pushed off, may be effected by a further machine component, such as a releaser element that acts on a release element of the carrier means. For example, the carrier means may have a release element, which is configured such that in response to displacement of the release element, the push-off element performs a push-off movement driven by the mechanical actuator. Actuation of the release element preferably disengages the form fit created during pretensioning, thereby releasing the push-off element and enabling it to move out of a retracted position. It is advantageous for the aforementioned releaser element to act simultaneously for carrier means arranged at arbitrary components of a handling device, such as the receiving device, thereby keeping the number of parts small and promoting profitability and reliability. This can be effected, in the case of carrier means that rotate about a common axis, in such a way that the releaser element has, in the rotational direction of the carrier means, an angular extension that enables it to reach a release element of a carrier means at every possible angular position of the carrier means. A releaser element of this kind may extend as an arc and, in particular, as a circular arc. A releaser element of this kind may act, relative to a common axis, at a radial distance corresponding to the radial distance of the release element from a rotation centre of the carrier means. The releaser element preferably acts in a direction parallel to a common axis. In one form, the releaser element is movable orthogonally to a direction of movement of the at least one of the carrier means. The releaser element may be configured to displace the release element of the carrier means when the release element is located at an arbitrary component of the receiving device. The releaser element preferably acts on the carrier means from the side opposite the direction of a weaving accessory held to the carrier means.

An associated carrier means with a complementary holding element may be assigned to each carrier means (and each holding element) respectively, the associated carrier means being disposed at an axial distance along a common axis running at right angles to a plane in which movement of a holding element takes place. This axial distance can be adjusted to the length of the weaving accessory. The holding elements may be distributed on two planes, which are at right angles to the axial direction along a common axis. The holding element of the associated carrier means in each case serves, together with the respective complementary holding element, to hold a weaving accessory under tensile stress, and in particular, to handle a longitudinally pretensioned weaving accessory, near its two ends, in its longitudinal direction. In this way, troublesome movements of the weaving accessory between the holding elements are at least partially suppressed. At least one of two complementary holding elements may be arranged movably at the respective carrier means so that the weaving accessory can be held pretensioned between the two complementary holding elements. The movable holding element is preferably arranged at the carrier means in such a way that the weaving accessory is in the pretensioned state when no external force is acting. It is advantageous if the device has a detensioner element which is able to displace the holding element or a detensioning pressure element assigned to the holding element. The displacement is preferably parallel to a direction of a common axis. In one form, the detensioner element is movable orthogonally to the direction of movement of the holding elements. A holding element arranged movably at the carrier means may be disposed pivotable around a bearing axis of the holding element. The detensioner element may, like the releaser element, extend angularly in such a manner that a holding element at any component of the receiving device can be displaced. An additional detensioner element, which works in the same way, may be assigned to the supply device. The detensioner element moves in the same direction as the releaser element. In particular, the detensioner element and the releaser element may be configured integrally at the receiving device, thereby reducing the number of parts and enhancing the reliability. It is preferable, however, for the detensioner element to act before the releaser element.

It is advantageous for the at least two holding elements to be disposed rotatably around a common axis. It is also advantageous if the at least two holding elements are disposed around the common axis independently of one another with respect to their angular position. Different holding elements arranged in one plane cannot be located at identical angular positions. A given minimum distance in the angular position is necessary to prevent the carrier means from colliding. It is to advantage for carrier means that act in a common plane, for example the carrier means for the first holding element and the carrier means for the at least one further holding element, to be arranged on mutually embracing shafts around a common axis. The carrier means may be driven by electric motors. Each carrier means may have its own separate electric motor.

The method according to the invention for handling weaving accessories comprises the cyclic motion of a first holding element and at least one further holding element for weaving accessories between a supply device and a receiving device. The method according to the invention is characterised in that at least the first holding element completes at least part of its cyclic movement between the supply device and the receiving device while the at least one further holding element remains stationary. This independent movement of two or more holding elements enables the device to be operated at a high repetition rate because, on completion of a handling process, each holding element can transport a weaving accessory attached thereto further or pick up a new weaving accessory without having to wait for the completion of other handling processes. As a result, all handling processes can be completed optimally in quick succession. Weaving accessories can also be drawn in flexibly at a high repetition rate because lengthy distances between individual handling devices, caused by specific drawing-in configurations, do not necessarily slow down the other handling processes and movements of carrier means.

At a supply device, a complementary first holding element and/or at least one complementary further holding element may be displaced in a direction parallel to a common axis by a detensioner element, thereby enabling a weaving accessory to be picked up.

DETAILED DESCRIPTION

Figure 1:
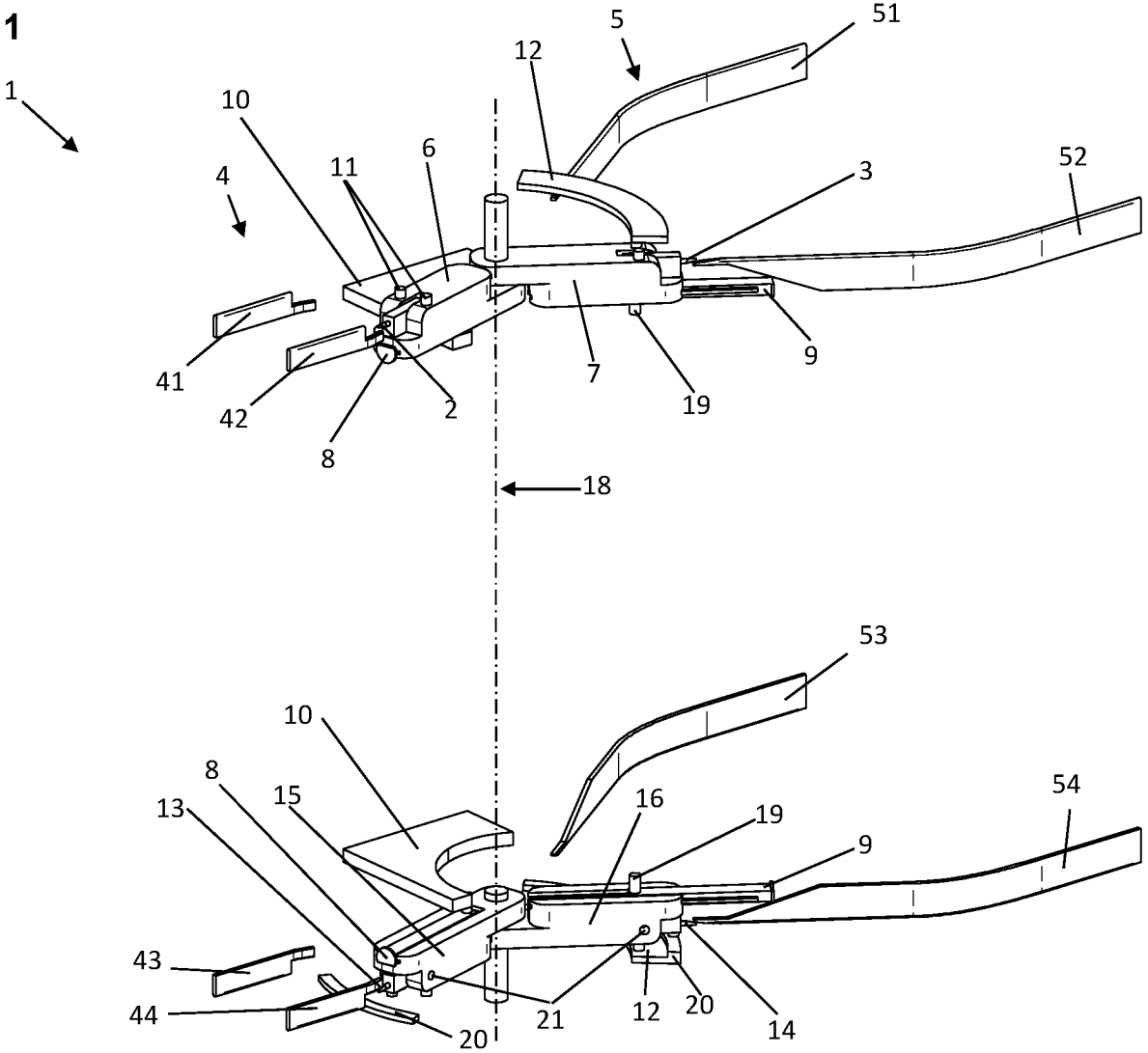
FIG. 1 shows a symbolic oblique view of essential components of the device according to the invention.

FIG. 1 shows a symbolic oblique view of essential components of the device 1 according to the invention. Along the common axis 18, two holding elements 2 and 3 are shown in an upper area of the device 1 and two holding elements 13 and 14 are shown in a lower area of the device 1. The holding elements 2, 3, 13 and 14 are provided for transport non-portrayed weaving accessories from a supply device 4 on the left in the drawing to a receiving device 5 on the right in the drawing. The supply device 4 shown in the drawing comprises two upper components 41 and 42, which are shown as rails, and two lower components or rails 43 and 44, on which weaving accessories may be positioned in readiness and picked up by the holding elements 2, 3, 13 and 14. The receiving device 5 shown in the drawing comprises two components or rails 51 and 52 in the upper area and two rails 53 and 54 in the lower area, onto which the drawn-in weaving accessories can be transferred. In all conceivable embodiments, both the supply device 4 and the receiving device 5 can have, independently of each other, a different number of rails or components in general, whose number can range from 1 up to 24, for example.

The first holding element 2 is arranged at a carrier means 6. The second holding element 3 is arranged at a carrier means 7. The complementary first holding element 13 is arranged at a carrier means 15. The complementary further holding element 14 is arranged at a carrier means 16. The carrier means 6, 7, 15 and 16 are arranged rotatably around the common axis 18. The first holding element 2 and the complementary first holding element 13 can transport a pretensioned heald at its end loops from the supply device 4 to the receiving device 5. Similarly, the further holding element 3 and the complementary further holding element 14 can transport a pretensioned heald at its end loops from the supply device 4 to the receiving device 5. For this purpose, the holding elements 13 and 14 are attached pivotable to the carrier means 15 and 16, as is indicated by the bearing axis 21. In order to detension the healds, the holding elements 13 and 14 can be moved upwards, as per the drawing, with the detensioner elements 20. The detensioner element 20 shown on the right in the drawing is configured integrally with a releaser element 12. In this way, a tension-free heald can be transferred by the push-off element 9 of the carrier means 7 and 16 onto a rail 52 and 54 of the receiving device. The push-off elements 9 are shown appropriately in the extracted state. The push-off elements 8 are shown in the tensioned state. In the embodiment shown, the carrier means 7 and 16 first of all rotate from the rails 52 and 54 further to the rails 51 and 53. The carrier means 7 and 16 then pass the stationary device elements 10, which come into engagement with the pretensioning elements 19 and thereby convert the push-off elements from the extracted state (shown as push-off elements 9) into the tensioned state (shown as push-off elements 8), as shown in the case of the carrier means 6 and 15.

The releaser elements 12 interact with release elements 11 in order to unlock the push-off elements 8 and thus to convert them from the tensioned state (shown as push-off elements 8) into the extracted state (shown as push-off elements 9). For this purpose, the releaser elements 12 perform a movement parallel to the common axis 18. Two release elements 11 are shown for each carrier means 6, 7, 15 and 16. In other embodiments, the carrier means 6, 7, 15 and 16 may only have one release element 11.

Figure 2:
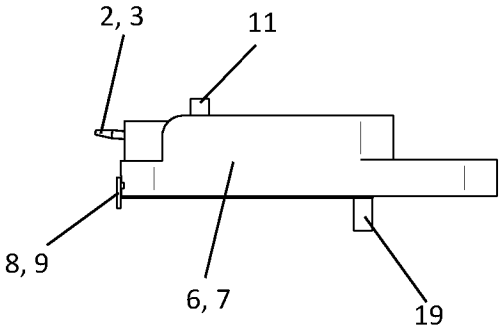
FIG. 2 shows a symbolic side view of a carrier means for a first or further holding element.

FIG. 2 shows a symbolic side view of a carrier means 6 or 7 for a first or further holding element 2 or 3. In this enlarged view, the pencil-shaped configuration of the holding element 2 or 3 is more easily recognizable. The push-off element 8 is shown in the tensioned state.

Figure 3:
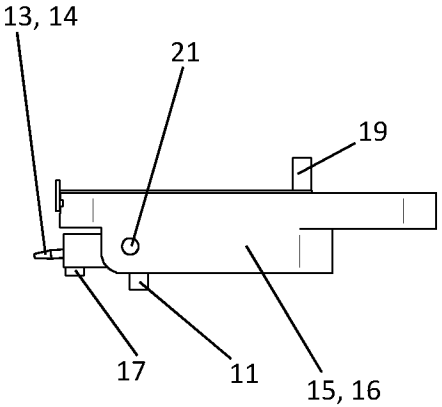
FIG. 3 shows a symbolic side view of a carrier means for a complementary first or complementary further holding element.

FIG. 3 shows a symbolic side view of a carrier means 15 or 16 for a complementary first holding element 13 or complementary further holding element 14. Compared to FIG. 2, the carrier means 15 or 16 shown here comprises a bearing axis 21 for the movable arrangement of holding elements 13 and 14. In addition, the drawing shows an optional detensioning pressure element 17. Accordingly, the detensioner element 20 does not press directly on the pivotable holding element.

List of reference numerals

| | |
|---|---|
| 1 | Device |
| 2 | First holding element |
| 3 | Further holding element |
| 4 | Supply device |
| 5 | Receiving device |
| 6 | Carrier means of the first holding element |
| 7 | Carrier means of the at least one further holding element |
| 8 | Tensioned push-off element |
| 9 | Extracted push-off element |
| 10 | Stationary device element |
| 11 | Release element |
| 12 | Releaser element |
| 13 | Complementary first holding element |
| 14 | Complementary further holding element |
| 15 | Carrier means of the first holding element |
| 16 | Carrier means of the complementary further holding element |
| 17 | Detensioning pressure element |
| 18 | Common axis |
| 19 | Pretensioning element |
| 20 | Detensioner element |
| 21 | Bearing axis of the holding element |
| 41 | Component of the supply device 4 |
| 42 | Component of the supply device 4 |
| 43 | Component of the supply device 4 |
| 44 | Component of the supply device 4 |
| 51 | Component of the receiving device 5 |
| 52 | Component of the receiving device 5 |
| 53 | Component of the receiving device 5 |
| 54 | Component of the receiving device 5 |

The invention claimed is:

1. A device (1) for handling weaving accessories, the device comprising:

a first holding element (2) for holding a weaving accessory of the weaving accessories and at least one further holding element (3) for holding a further weaving accessory of the weaving accessories;

wherein the first holding element (2) and the at least one further holding element (3) are configured to be moved cyclically between a supply device (4) and a receiving device (5) to transport the weaving accessory in engagement with the first holding element (2) and the further weaving accessory in engagement with the at least one further holding element (3) from the supply device (4) to the receiving device (5);

wherein at least the first holding element (2) is configured to complete at least part of a movement between the supply device (4) and the receiving device (5) while the at least one further holding element (3) remains stationary;

wherein the first holding element (2) is operably connected to a carrier means (6) of the first holding element (2) and the at least one further holding element (3) is operably connected to a carrier means (7) of the at least one further holding element (3); and further comprising a push-off element (8, 9) operably connected to at least one of the carrier means (6, 7) configured to push one of the weaving accessory and the further weaving accessory of the weaving accessories onto a one of a plurality of components (51, 52, 53 54) of the receiving device (5).

2. The device (1) according to claim 1, wherein the push-off element (8, 9) is configured to be moved by a mechanical actuator operably connected to at least one of the carrier means (6, 7) and a mechanical tension is built up in the mechanical actuator by a stationary device element (10) when the at least one of the carrier means (6, 7) moves past the stationary device element (10).

3. The device (1) according to claim 2, wherein the at least one of the carrier means (6, 7) has a release element (11), which is configured such that in response to displacement of the release element (11), the push-off element (8, 9) performs a push-off movement driven by the mechanical actuator.

4. The device (1) according to claim 3, further comprising a releaser element (12), which is movable orthogonally to a direction of movement of the at least one of the carrier means (6, 7), for displacement of the release element (11) of the at least one of the carrier means (6, 7), wherein the releaser element (12) is configured to displace the release element (11) of the at least one of the carrier means (6, 7) when the release element (11) is located at an arbitrary one of the plurality of components (51, 52, 53, 54) of the receiving device (5).

5. The device (1) according to claim 1, further comprising, spaced along a common axis (18), a complementary first holding element (13) corresponding to the first holding element (2) andat least one complementary further holding element (14) corresponding to the at least one further holding element (3), wherein the complementary first holding element (13) is movably connected to a carrier means (15) of the complementary first holding element (13) and the at least one complementary further holding element (14) is movably connected to a carrier means (16) of the at least one complementary further holding element (14) for holding the weaving accessory and/or the further weaving accessory under tensile stress between the first holding element (2) and the complementary first holding element (13) and/or between the at least one further holding element (3) and the at least one complementary further holding element (14), wherein the common axis (18) extends orthogonally to a plane in which the first holding element (2) performs its cyclic motion.

6. The device (1) according to claim 5, wherein the complementary first holding element (13) and the at least one complementary further holding element (14) are configured to be displaced by at least one detensioner element (20), which is movable orthogonally to a direction of movement of the holding elements (2, 3, 13, 14), and the at least one detensioner element (20) is configured to displace the complementary first holding element (13) and the at least one complementary further holding element (14) in order to detension the weaving accessory and the further weaving accessory when the carrier means (15, 16) of the complementary holding elements (13, 14) are located at arbitrary components (41, 42, 43, 44, 51, 52, 53, 54) of the supply device (4) or the receiving device (5).

7. The device (1) according to claim 5, wherein the first holding element (2) and the at least one further holding element (3) are disposed in a first plane and are configured to move between the supply device (4) and the receiving device (5) in the first plane.

8. The device (1) according to claim 7, wherein the complementary first holding element (13) and the at least one complementary further holding element (14) are disposed in a second plane and are configured to move between the supply device (4) and the receiving device (5) in the second plane and wherein a distance between the first and second planes is adjustable.

9. The device according to claim 5, wherein the first holding element (2) and the at least one further holding element (3) are disposed rotatably about a common axis (18).

10. The device (1) according to claim 9, wherein the complementary first holding element (13) and the at least one complementary further holding element (14) are disposed rotatably about the common axis (18).

11. The device (1) according to claim 9, wherein the carrier means (6) of the first holding element (2) and the carrier means (7) of the at least one further holding element (3) are disposed on mutually embracing shafts around the common axis (18).

12. A method for handling weaving accessories, comprising:

cyclically moving a first holding element (2) for a weaving accessory of the weaving accessories and at least one further holding element (3) for a further weaving accessory of the weaving accessories between a supply device (4) and a receiving device (5) to transport the weaving accessory in engagement with the first holding element (2) and the further weaving accessory in engagement with the at least one further holding element (3) from the supply device (4) to the receiving device (5);

wherein at least the first holding element (2) completes at least part of its cyclic movement between the supply device (4) and the receiving device (5) while the at least one further holding element (3) remains stationary; and displacing a complementary first holding element (13) and/or at least one complementary further holding element (14) at the supply device (4) with a detensioner element (20) in a direction parallel to a common axis (18) to pick up the weaving accessory and/or the further weaving accessory of the weaving accessories.

13. A method for handling weaving accessories, comprising:

cyclically moving a first holding element (2) for a weaving accessory of the weaving accessories and at least one further holding element (3) for a further weaving accessory of the weaving accessories between a supply device (4) and a receiving device (5) to transport the weaving accessory in engagement with the first holding element (2) and the further weaving accessory in engagement with the at least one further holding element (3) from the supply device (4) to the receiving device (5);

wherein at least the first holding element (2) completes at least part of its cyclic movement between the supply device (4) and the receiving device (5) while the at least one further holding element (3) remains stationary; and displacing a complementary first holding element (13) and/or at least one complementary further holding element (14) at the receiving device (5) with a detensioner element (20) in a direction parallel to a common axis (18) to hand over the weaving accessory and/or the further weaving accessory of the weaving accessories.

* * * * *